United States Patent [19]

Holtje

[11] Patent Number: 4,898,375

[45] Date of Patent: Feb. 6, 1990

[54] FEED DEVICE WITH AUTOMATIC SHEET ALIGNMENT

[75] Inventor: Bruce E. Holtje, Castle Creek, N.Y.

[73] Assignee: Imagitek, Inc., Binghamton, N.Y.

[21] Appl. No.: 151,482

[22] Filed: Feb. 2, 1988

[51] Int. Cl.[4] ..... B65H 9/06

[52] U.S. Cl. ..... 271/246

[58] Field of Search ..... 271/227, 245, 246

[56] References Cited

U.S. PATENT DOCUMENTS

| | | | |
|---|---|---|---|
| 3,630,519 | 12/1971 | Spear | 271/246 |
| 4,526,309 | 7/1985 | Taylor | 271/246 X |
| 4,674,735 | 6/1987 | DuBois | 271/246 X |

*Primary Examiner*—Richard A. Schacher

*Attorney, Agent, or Firm*—Kane, Dalsimer, Sullivan, Kurucz, Levy, Eisele and Richard

[57] ABSTRACT

This invention relates to a feed device which automatically straightens sheets prior to their being fed.

A nudge wheel feeds the paper into the apparatus against a registration gate thereby straightening the sheet.

At the appropriate time, a solenoid actuated clutch initiates a mechanically sequenced series of events which raise a set of feed tires so as to pinch (hold and secure) the previously straightened sheet, lower the registration gate out of the paper path, and start the feed tires and allow the sheet to be fed.

At a second appropriate time after the sheet has been fed, the solenoid clutch is de-energized. Stored energy in a spring is used to mechanically reverse the sequence, whereby the feed tires are lowered out of the paper path and the registration gate is raised up into the paper path, preparatory to the next sheet.

12 Claims, 6 Drawing Sheets

FIG. 1
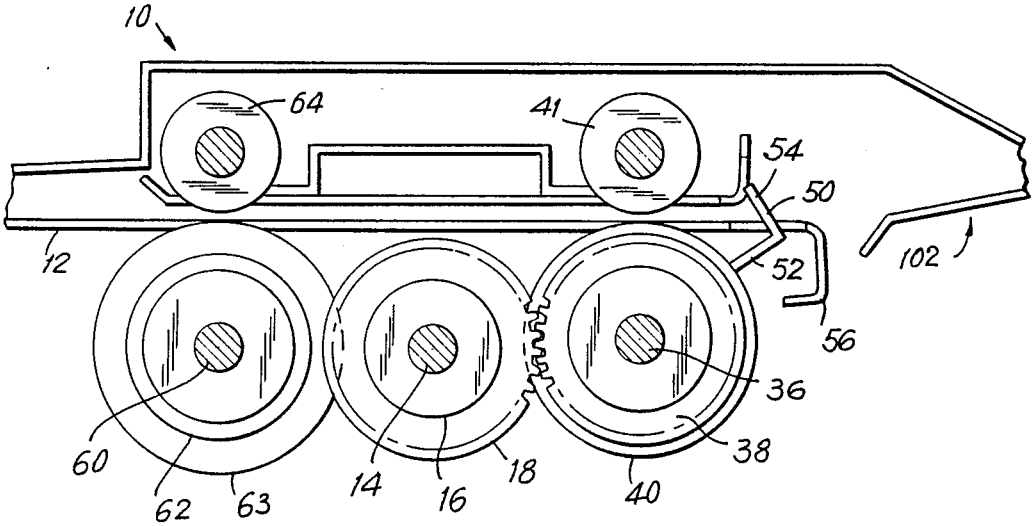
FIG. 10A
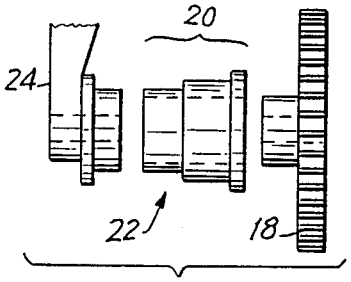
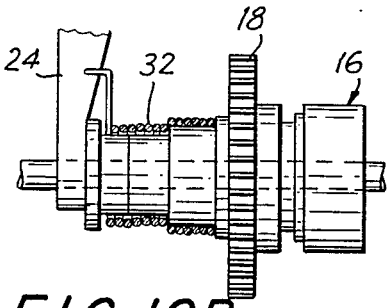
FIG. 10B

FEED DEVICE WITH AUTOMATIC SHEET ALIGNMENT

BACKGROUND OF THE INVENTION

1. Field of the Invention

This invention relates to a device which automatically aligns large sheets of paper, film, or similar material during an initial feeding process. This is particularly useful in copying, photographic, printing or similar operations.

2. Description of the Prior Art

In the prior art, the user of a feed device for a large sheet of paper or similar material had to be careful to feed the paper straight into the device. Any misalignment of the paper in, for instance, a xerographic, photographic or printing process, resulted in an image which was skewed on the sheet. The process would, of course, therefore produce an unaesthetic and unappealing product at best and at worst could result in lost information.

A common improvised solution was to present a guide in the form of a wall parallel to the direction of travel of the paper. The user abutted the sheet firmly against the guide prior to the feeding process. In order to provide for differing sizes of sheets of paper, such guides were adjustable in the direction perpendicular to the direction of travel of the sheet. Additionally, in either the fixed or adjustable mode, a guide was provided for one or both sides of the paper.

However, this method is error-prone and time-consuming in that it is a manual process. It is particularly time consuming when the guides must be continually adjusted due to changing sizes of paper.

Furthermore, such a mechanism is not easily adapted to a fully automated process in that it merely provides guidance during manual intervention, rather than reliable alignment in the absence of human intervention.

Other true solutions to this problem have required the use of two or more control elements, such as clutches or solenoids, to control a registration gate and a set of feed tires or rollers.

Mechanisms which have reduced the control elements to one have required active elements on both sides of the media path, impractical for very large (wide) sheets.

OBJECTS AND SUMMARY OF THE INVENTION

It is therefore an object of this invention to provide a feed mechanism for sheets of paper or similar material which would automatically align the sheets reliably at a high throughput rate.

It is a further object of this invention to make such a mechanism which is adaptable to manual or automated operation.

It is a further object of this invention to make such a mechanism which operates from one side of the paper path, and requires only one control element, and is very inexpensive.

In accordance with the present invention, a feed mechanism is provided which has the ability to run in two modes. The first mode is initiated by supplying mechanical power input into the mechanism. This input will drive a nudge or prefeed tire that will receive a document and drive it into the machine towards a registration gate.

The second mode is selected by engaging a clutch. This clutch initiates a mechanically sequenced series of actions which will grip the document, lower the registration gate, and drive the document into the machine.

After the sheet has passed through the feed mechanism, power is removed from the clutch, and the system restores to the first mode. The mechanism is mechanically self-restoring and preserves energy to maintain this position. Removal or stopping the mechanical power into the feed mechanism stops the nudge or prefeed.

BRIEF DESCRIPTION OF THE DRAWINGS

Further objects and advantages of the invention will become apparent from the following descriptions and claims, and from the accompanying drawings, wherein:

FIG. 1 is a plan view of the side of the apparatus in combination with a series of drive mechanisms of a typical application.

FIG. 10A is a perspective exploded view of clutch.

FIG. 10B is a perspective view of the assembled clutch.

DETAILED DESCRIPTION OF THE PREFERRED EMBODIMENT

Figure 2:
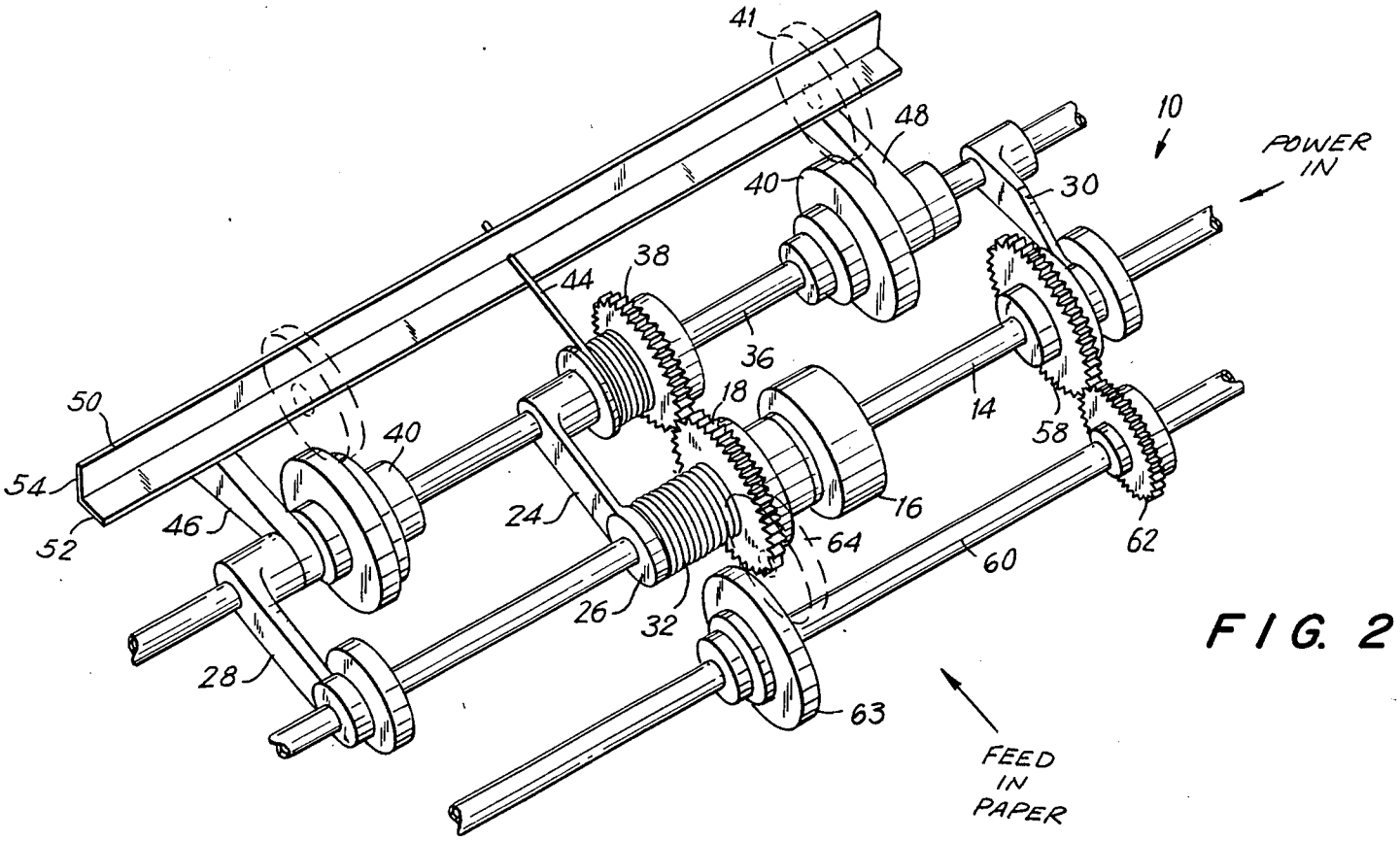
FIG. 2 is an isometric view of the invention.
Figure 3:
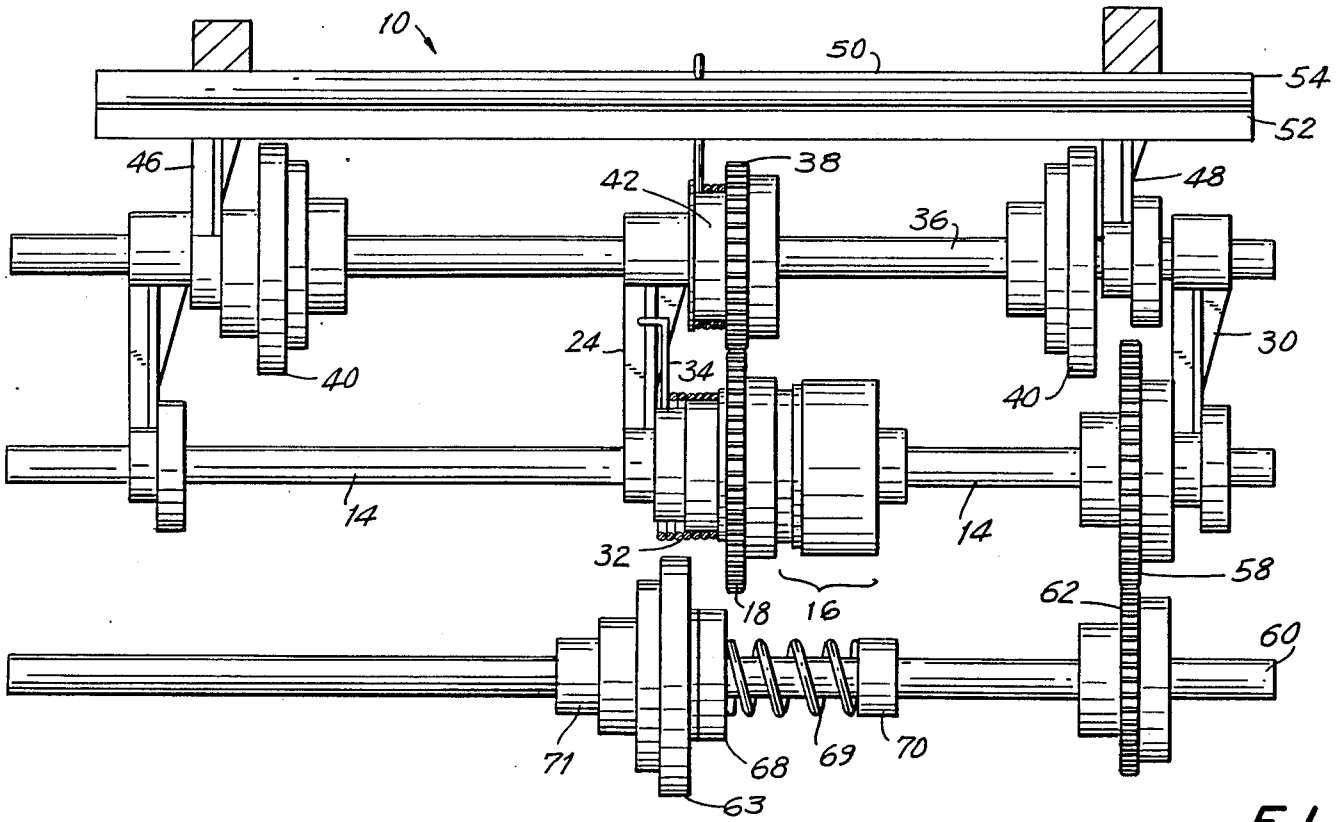
FIG. 3 is a plan view of the top of the invention.
Figure 5:
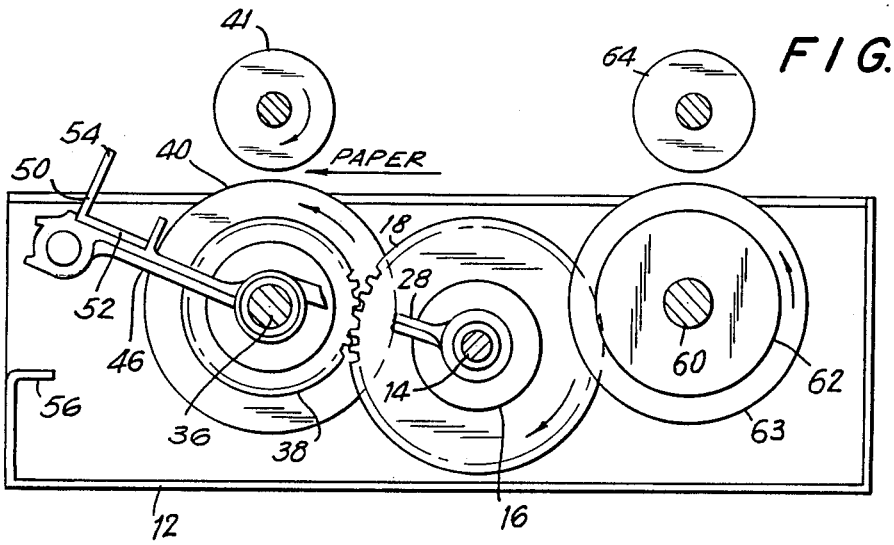
FIG. 5 is a cross-sectional view of the side of the invention with the clutch as shown in plane 5 of FIG. 4.
Figure 4:
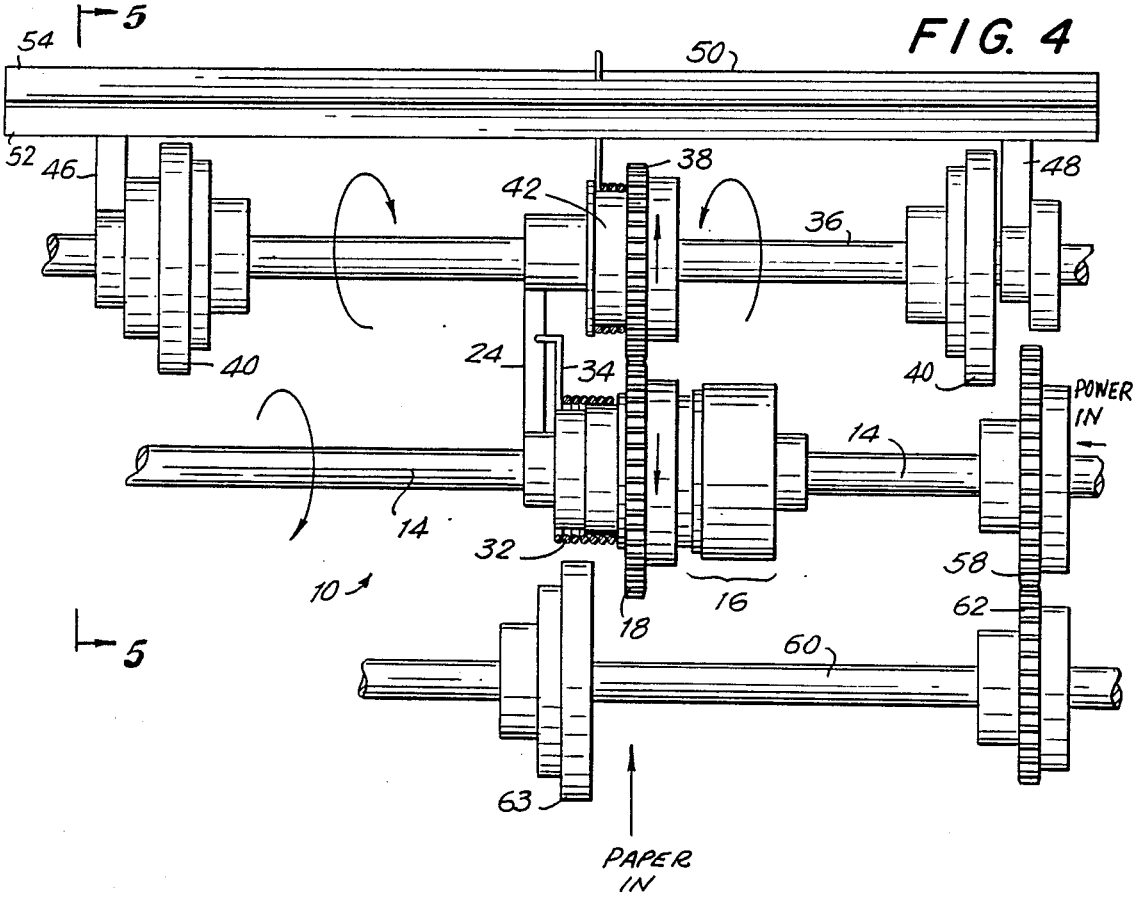
FIG. 4 is a plan view of the top of the invention showing the power path when the clutch is engaged.

Referring now to the drawings in detail wherein like numerals indicate like elements throughout the several views, the apparatus 10 of the present invention, which is attached to a sheet-receiving device 102, includes a frame 12 which supports both ends of a drive shaft 14 which is journalled for rotation and adapted to receive rotational energy from an external source (not shown).

The middle portion of drive shaft 14 is journalled for rotation through the longitudinal axis of clutch 16. Clutch 16 receives its input from drive shaft 14. Clutch 16 is energized or de-energized by its internal solenoid 17 which is, in turn, responsive to the control circuitry (not shown) of sheet receiving device 102. Adjacent to clutch 16 is primary feed drive gear 18 which receives the output of clutch 16. That is, primary feed drive gear 18 is stationary when then clutch 16 is disengaged, and primary feed drive gear 18 turns in concert with drive shaft 14 when clutch 16 is engaged.

Collar 20 is integral with primary feed drive gear 18 and turns in concert therewith. Collar 20 is formed of steel or a similar hard material. Additionally, collar 20 includes a recessed region 22 of reduced diameter. Link arm 24 is adjacent to collar 20. The lower head 26 of link arm 24 is journalled for rotation about drive shaft 14 and is adjacent to recessed region 22 of collar 20. Link arms 28 and 30 are pivotable about drive shaft 14 at the locations inwardly adjacent to where the frame 12 receives drive shaft 14.

Feed/reg engage wrap spring 32 is coiled around collar 20, recessed region 22, and lower head 26 of link arm 24. The diameter of lower head 26 of link arm 24 is equal to the diameter of recessed region 22 of collar 20. This diameter is less than that of collar 20. The diameter of collar 20 is greater than the diameter of the feed/reg engage wrap spring 32 in its free state. The recessed region 22 of collar 20 is also smaller in diameter than the free state of wrap-spring 32. The forward end 34 of feed/reg engage wrap spring 32 engages link arm 24.

Feed drive shaft 36 is parallel to drive shaft 14 and is journalled for rotation about the distal ends of link arms 24, 28 and 30. Secondary feed gear 38 is integrally mounted on feed drive shaft 36 so as to rotate in concert therewith and to engage primary feed gear 18. This translates rotation of the primary feed gear 18 into rotation of feed drive shaft 36. On both ends of the feed drive shaft 36 are feed tires 40.

When feed drive shaft 36 pivots on link arms 24, 28 and 30 upward, feed tires 40 engage workpiece sheet 100 from below and are restrained by fixed feed idler wheels 41 from above.

Secondary feed gear 38 includes a steel or similar hard material hub 42 about which a registration gate lift/lower wrap spring 44 is coiled.

Figure 6:
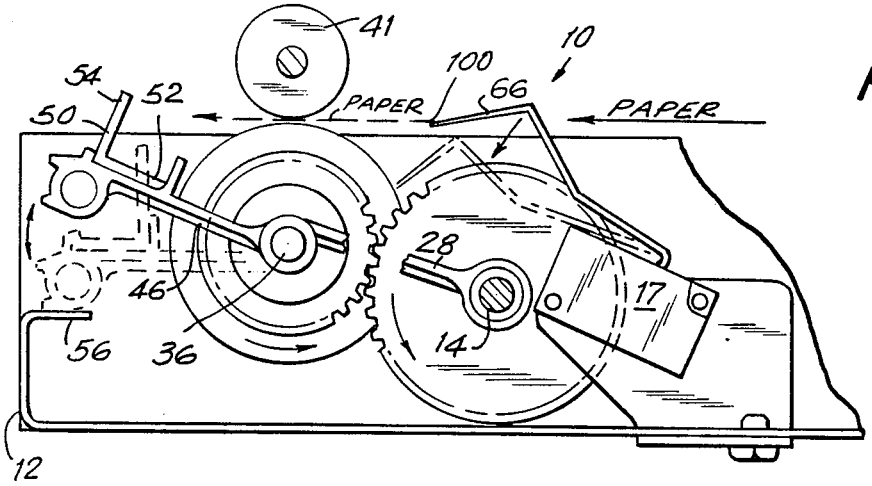
FIG. 6 is a plan view of the side of the invention with the clutch engaged, showing the open position of the registration gate in phantom.

Inwardly adjacent to where link arms 28 and 30 provide support for feed drive shaft 36, link arms 46 and 48 are journalled for rotation about feed drive shaft 36. The distal ends of link arms 46 and 48 provide support for registration gate 50 which is parallel to the feed drive shaft 36. Registration gate 50 has a L-shaped cross section with a lower horizontal leg 52 attached to the distal ends of link arms 46 and 48 and the distal end of registration gate light lower wrap spring 44. A vertical leg 54 blocks the path of sheet 100 when registration gate 50 is in its upright position as shown in FIG. 6. Additionally, a stop 56 limits the downward movement of registration gate 50.

Inwardly adjacent to the proximate end of link arm 30, primary nudge drive gear 58 is firmly affixed to drive shaft 14 so as to rotate in concert therewith.

Nudge drive shaft 60 is journalled for rotation on frame 12, parallel to shafts 14 and 36. Secondary nudge drive gear 62 is integrally mounted on nudge drive shaft 60 so as to rotate in concert therewith and to engage primary nudge drive gear 58. This translates rotation of drive shaft 14 into rotation of nudge drive shaft 60. Nudge tire 63 is mounted in the center of nudge drive shaft 60 and receives rotational motion through a friction disk clutch 68 tensioned by spring 69 between collars 70 and 71 both fixed to shaft 60 so that nudge tire 63 generally rotates in concert with nudge drive shaft 60 as it engages nudge idler wheel 64. However, if a sufficient load or resistance is placed upon nudge tire 63, nudge tire 63 may rotate at a slower frequency than nudge drive shaft 60 or stop, or even reverse.

Additionally, sheet sensor 66 is depressed whenever a sheet workpiece 100 is in the apparatus 10, so as to notify the control circuitry (not shown) of sheet-receiving device 102 to which clutch 16 via internal solenoid 17 is responsive.

When apparatus 10 is ready to receive a sheet workpiece 100, sheet sensor 66 is in its upright position as shown in FIG. 6. Rotational energy is received from an external source (not shown) to drive shaft 14 which, in turn, drives primary nudge drive gear 58, secondary nudge drive gear 62, nudge tire 63, and nudge idler wheel 64. Clutch 16 is disengaged, so primary feed drive gear 18 is stationary. The feed drive shaft 36 is in its lower position so that feed tires 40 are substantially separated from feed idler wheels 41. Registration gate lift/lower wrap spring 44 holds registration gate 50 in its upward position.

Figure 7:
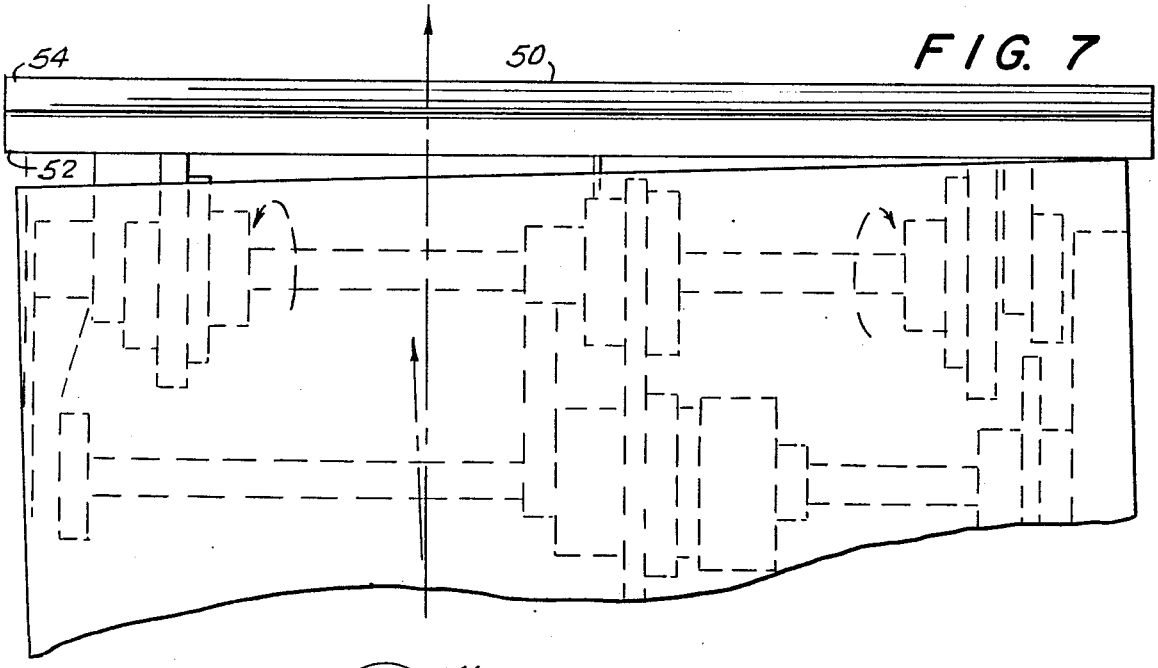
FIG. 7 is a plan view of the top of the invention as it corrects misalignment in a sheet of paper.
Figure 8:
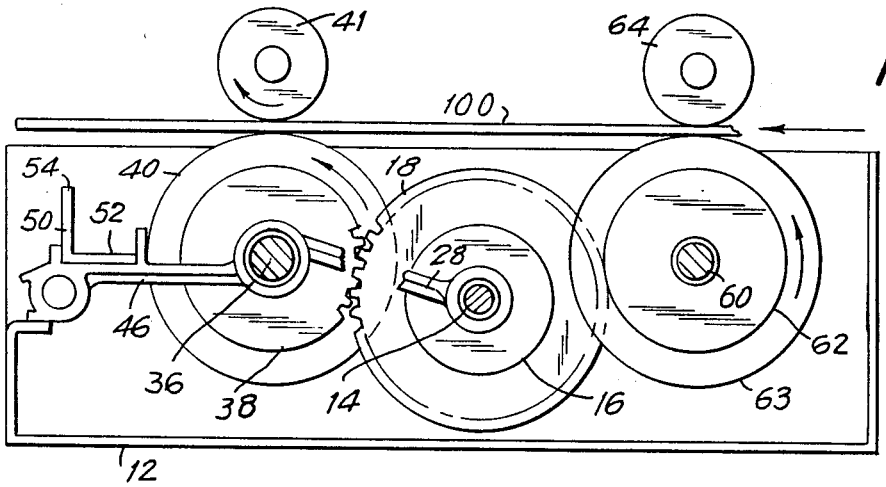
FIG. 8 is a plan view of the side of the invention with registration gate open.
Figure 9:
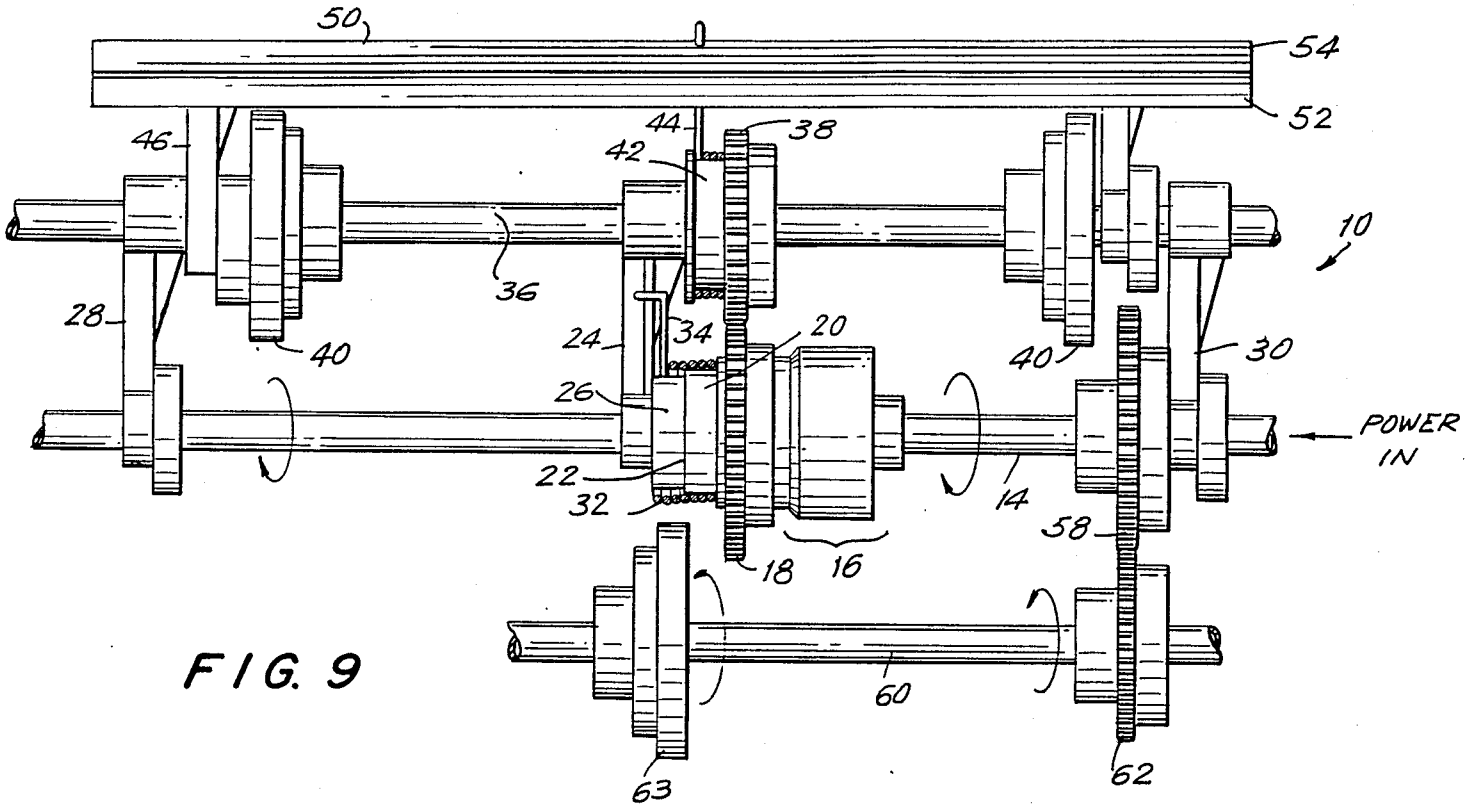
FIG. 9 is a plan view of the top of the invention showing the power path when the clutch is disengaged.

When the sheet workpiece 100 is inserted by the user, it is drawn between nudge tire 63 and nudge idler wheel 64 into the apparatus 10 so that the forward end of the sheet workpiece 100 is abutted against the registration gate 50. Sheet sensor 66 is depressed by sheet workpiece 100 thereby communicating to the control circuitry (not shown) of sheet-receiving device 102. If the sheet workpiece has been inserted crooked, the nudge tire 63 and the first corner of sheet workpiece 100 to abut registration gate 50 set up a moment couple as a resistance and a driving force are set up on a triangular basis as shown in FIG. 7, thereby forcing the sheet workpiece 100 to abut squarely the registration gate 50. When the sheet workpiece 100 squarely abuts registration gate, the beam strength of the sheet workpiece 100 places a sufficient load or resistance on nudge tire 63 such that the friction clutch of nudge tire 63 slips such that the rotation of nudge tire 63 is reduced or stopped.

Meanwhile, the control circuitry (not shown) of sheet receiving device 102 takes into account such factors as the internal parameters and requirements of sheet receiving device 102, the activation of sheet sensor 66, and the characteristics of sheet workpiece 100 thereby calculating a time to energize clutch 16 via internal solenoid 17. When clutch 16 is energized, primary feed drive gear 18 starts to turn. Feed gear 18 in turn turns collar 20. Wrap-spring 32 is employed in a torque limiting mode wherein the rotation of collar 20 tends to unwrap the tightly wound coils of wrap-spring 32 on collar 20 until they unwrap sufficiently as to increase their diameter and cease to grip collar 20 and start to slip. The distal end of wrap-spring 32 lifts link-arm 24 with the available torque wound into wrap spring 32 by feed gear 18. When link arm 24 lifts, this causes feed tires 40 to close the nip between tires 40 and feed idler wheels 41 thereby engaging or gripping the sheet workpiece 100 between them. When the drive shaft 14 is in this uppermost position, the feed/reg engage wrap spring 32 slips on collar 20. The rotation of primary feed gear 18 is then directly translated into the rotation of secondary feed gear 38, feed drive shaft 36, feed tires 40, and feed idler wheels 41. Additionally, the rotation of feed drive shaft 36 unwraps registration gate lift/lower wrap spring 44 (torque limiting mode) thereby lowering registration gate 50 to stop 56 and allowing the rotation of feed tires 40 to drive the sheet workpiece 100 into sheet receiving device 102.

After sheet workpiece 100 has been completely fed through apparatus 10, sensor 66 raises to its original position. Control circuitry (not shown) of sheet receiving device 102 takes this into account along with internal parameters and conditions of sheet-receiving device 102 in order to generate a signal to deactivate the clutch 16 via internal solenoid 17 so as to stop the rotation of primary feed gear 18. Some rotational energy stored in feed/reg engage wrap spring 32 in the areas of reduced region 22 of collar 20 and hub 24 now releases, thereby transmitting energy to turn link arm 24 down and in a one-way clutch mode to rotate primary feed gear 18 and secondary feed gear 38 backwards about a quarter turn so as to lower feed drive shaft 36 to its original position. Similarly, as secondary feed gear 38 has stopped and turned backwards, registration gate lift/- lower wrap spring 44 wraps down and acts as a one-way clutch, to raise the registration gate 50 to its upright position. A portion of the stored rotational energy of wrap spring 32 is used to lower the feed shaft 36 and to raise registration gate 50. The remaining stored energy keeps a torque moment about primary feed gear 18 and secondary feed gear 38 so as to maintain registration gate 50 in its upright position.

What is claimed is:

1. An apparatus for aligning a sheet during a feeding process comprising:

a first power driven roller means;

a first idler means positioned so as to engage the sheet between said first roller means and said first idler means and feed the sheet in a given direction;

a second power driven roller means;

a second idler means;

a registration gate which is substantially perpendicular to said given direction and placed in relation to said first roller means and said first idler means so that a forward edge of the sheet may be abutted against the gate so as to block said given direction of travel of the sheet;

wherein said registration gate removing means includes a first wrap spring responsive to said second power driven roller means;

means for engaging the sheet between said second power driven roller means and said second idler means after said first power driven roller means has abutted the sheet against said registration gate;

said registration gate removing means operates substantially simultaneously with said engaging means; and means for removing said registration gate from said direction of travel after said first roller means and said idler means have engaged the sheet for a preselected period.

2. The apparatus of claim 1 further including means for selectively directing power to said second power driven roller means.

3. The apparatus of claim 2 wherein said engaging means includes a second wrap spring responsive to said selective power directing means.

4. The apparatus of claim 2 wherein said power directing means is responsive to microprocessor control.

5. The apparatus of claim 2 wherein said selective power directing means is a clutch.

6. The apparatus of claim 3 wherein said selective power directing means is a clutch.

7. The apparatus of claim 6 wherein said first power driven roller means includes a nudge wheel mounted on a drive shaft by a friction clutch.

8. An apparatus for aligning a sheet during a feeding process comprising:

a first power driven roller means;

a first idler means positioned so as to engage a workpiece between first roller means and said first idler means and feed the sheet in a given direction;

a second power driven roller means;

a second idler means;

a registration gate which is substantially perpendicular to said given direction and placed in relation to said first roller means and said first idler means so that a forward edge of the sheet may be abutted against said gate so as to block said given direction of travel of said sheet;

means for selectively directing power to said second power driven roller means;

means for engaging the sheet between said second power driven roller means and said second idler means after said first power driven roller means has abutted the sheet against said registration gate, said engaging means including a wrap spring responsive to said selective power directing means; and, means for removing said registration gate from said direction of travel after said first roller means and said idler means have engaged the sheet for a preselected period, wherein said registration gate removing means and said engaging means operate substantially simultaneously.

9. The apparatus of claim 8 wherein said power directing means is responsive to microprocessor control.

10. The apparatus of claim 8 wherein said selective power directing means is a clutch.

11. The apparatus of claim 8 wherein said selective power directing means is a clutch.

12. The apparatus of claim 11 wherein said first power driven roller means includes a nudge wheel mounted on a drive shaft by a friction clutch.

* * * * *